US005082554A

United States Patent [19]

Bush et al.

[11] Patent Number: 5,082,554

[45] Date of Patent: Jan. 21, 1992

[54] FLOTATION PROCESS USING METAL SALTS OF PHOSPHORUS ACIDS

[75] Inventors: James H. Bush; Alan C. Clark, both of Mentor, Ohio

[73] Assignee: The Lubrizol Corporation, Wickliffe, Ohio

[21] Appl. No.: 538,959

[22] Filed: Jun. 15, 1990

[51] Int. Cl.[5] ..... B03D 1/014; B03D 1/02

[52] U.S. Cl. ..... 209/166; 252/61

[58] Field of Search ..... 207/166, 167; 252/61

[56] References Cited

U.S. PATENT DOCUMENTS

| | | | |
|---|---|---|---|
| 1,593,232 | 7/1926 | Whitworth . | |
| 1,812,839 | 6/1931 | Derby | 209/166 |
| 1,836,685 | 12/1931 | Romieux | 209/166 |
| 1,893,018 | 1/1933 | Christmann | 209/166 |
| 2,038,400 | 4/1936 | Whitworth | 209/166 |
| 2,206,284 | 7/1940 | Jayne, Jr. | 252/9 |
| 2,919,025 | 12/1959 | Booth et al. | 209/166 |
| 3,086,653 | 4/1963 | Booth | 209/166 |
| 3,570,772 | 3/1971 | Booth et al. | 241/24 |
| 4,283,017 | 8/1981 | Coale et al. | 241/24 |
| 4,460,459 | 7/1984 | Shaw et al. | 209/9 |
| 4,699,712 | 10/1987 | Unger | 209/166 |
| 4,879,022 | 11/1989 | Clark et al. | 209/166 |

FOREIGN PATENT DOCUMENTS

| | | | |
|---|---|---|---|
| 822901 | 4/1981 | U.S.S.R. | 209/166 |
| 310186 | 4/1929 | United Kingdom | 209/166 |

*Primary Examiner*—Stanley S. Silverman
*Assistant Examiner*—Thomas M. Lithgow
*Attorney, Agent, or Firm*—Frederick D. Hunter; Forrest L. Collins; James L. Cairns

[57] ABSTRACT

The present invention relates to improved process for beneficiating an ore-containing sulfide material. In particular, the process is useful for beneficiating ores and recovering metals such as gold, copper, lead, molybedenum, zinc, etc., from the ores. In one embodiment, the process comprises the steps of:

(1) forming a slurry comprising at least one crushed mineral-containing ore, water and a collector which is at least one metal salt of a phosphorus acid represented by the Formula:

$$(R_1)_2-\overset{\overset{\displaystyle X}{\|}}{P}-XH \qquad (I)$$

wherein each $R_1$ is independently a hydrocarbyl, hydrocarbyloxy or hydrocarbylthio group having from 1 to about 18 carbon atoms, each X is independently oxygen or sulfur, and wherein the metal is i) at least one single metal having a lowest oxidation state of plus two or ii) at least one mixture of metals wherein at least one of the metals has a lowest oxidation state of plus two, provided that when the primary mineral is copper, zinc or silver, the metal (i) is other than zinc.

(2) subjecting the slurry from step (1) to froth flotation to produce a froth; and (3) recovering a mineral from the froth.

27 Claims, No Drawings

FLOTATION PROCESS USING METAL SALTS OF PHOSPHORUS ACIDS

TECHNICAL FIELD OF THE INVENTION

This invention relates to froth flotation processes for the recovering of metal values from sulfide ores.

BACKGROUND OF THE INVENTION

Froth flotation is one of the most widely used processes for beneficiating ores containing valuable minerals. It is especially useful for separating finely ground valuable minerals from their associated gangue or for separating valuable minerals from one another. The process is based on the affinity of suitably prepared mineral surfaces for air bubbles. In froth flotation, a froth or a foam is formed by introducing air into an agitated pulp of the finely ground ore in water containing a frothing or foaming agent. A main advantage of separation by froth flotation is that it is a relatively efficient operation at a substantially lower cost than many other processes.

It is common practice to include in the flotation process, one or more reagents called collectors or promoters that impart selective hydrophobicity to the valuable mineral that is to be separated from the other minerals. It has been suggested that the flotation separation of one mineral species from another depends upon the relative wettability of mineral surfaces by water. Many types of compounds have been suggested and used as collectors in froth flotation processes for the recovery of metal values. Examples of such types of collectors include the xanthates, xanthate esters, dithiophosphates, dithiocarbamates, trithiocarbonates, mercaptans and thionocarbonates. Xanthates and dithiophosphates have been employed extensively as sulfide collectors in froth flotation of base metal sulfide ores.

Dialkyldithiophosphoric acids and salts thereof such as the sodium, potassium or ammonium salts have been utilized as promoters or collectors in the beneficiation of mineral-bearing ores by flotation for many years. Early references to these compounds and their use as flotation promoters may be found in, for example, U.S. Pat. Nos. 593,232 and 2,038,400. Ammonium salt solutions of the dithiophosphoric acids are disclosed as useful in U.S. Pat. No. 2,206,284, and hydrolyzed compounds are disclosed as useful in U.S. Pat. No. 2,919,025.

The dialkyldithiophosphoric acids utilized as flotation promoters and collectors for sulfide and precious metal ores are obtained by reacting an alcohol with phosphorus and sulfur generally as $P_2S_5$. The acid obtained in this manner can then be neutralized to form a salt.

U.S. Pat. No. 3,086,653 describes aqueous solutions of alkali and alkaline earth metal salts of phospho-organic compounds useful as promoters or collectors in froth flotation of sulfide ores. The phospho-organic compounds are neutralized $P_2S_5$-alkanol reaction products. Although single alcohols are normally used in the reaction, the patentees disclose that mixtures of isomers of the same alcohol, and mixtures of different alcohols may be utilized as starting materials in the preparation of the phosphorus compound, and the resulting acidic products can be readily neutralized to form stable solutions which are useful as flotation agents.

U.S. Pat. No. 3,570,772 describes the use of di(4,5-carbon branched primary alkyl) dithiophosphate promoters for the flotation of copper middlings. The 4 and 5 carbon alcohols used as starting materials may be either single alcohols or mixtures of alcohols.

U.S. Pat. No. 4,879,022 issued to Clark et al relates to a dithiophosphorus acid or salt used in a flotation process utilizing sulfurous acid. Thionocarbamate is disclosed as an auxilliary collector.

Procedures for the selective flotation of copper minerals from copper sulfide ores wherein a slurry of ore and water is prepared and sulfurous acid is added to the slurry to condition the slurry prior to the froth flotation step have been discussed in, for example, U.S. Pat. Nos. 4,283,017 and 4,460,459. Generally, the pulp is conditioned with sulfur dioxide as sulfurous acid under intense aeration.

SUMMARY OF THE INVENTION

The present invention relates to improved process for beneficiating an ore-containing sulfide material. In particular, the process is useful for beneficiating ores and recovering metals such as gold, copper, lead, molybdenum, zinc, etc., from the ores. In one embodiment, the process comprises the steps of:

(1) forming a slurry comprising at least one crushed mineral-containing ore, water and a collector which is at least one metal salt of a phosphorus acid represented by the Formula:

$$(R_1)_2-\overset{\overset{\displaystyle X}{\|}}{P}-XH \qquad (I)$$

wherein each $R_1$ is independently a hydrocarbyl, hydrocarbyloxy or hydrocarbylthio group having from 1 to about 18 carbon atoms, each X is independently oxygen or sulfur, and wherein the metal is i) at least one single metal having a lowest oxidation state of plus two or ii) at least one mixture of metals wherein at least one of the metals has a lowest oxidation state of plus two, provided that when the primary mineral is copper, zinc, lead or silver, the metal (i) is other than zinc.

(2) subjecting the slurry from step (1) to froth flotation to produce a froth; and (3) recovering a mineral from the froth.

DETAILED DESCRIPTION OF THE INVENTION

In the specification and claims, the term hydrocarbylene or alkylene is meant to refer to a divalent hydrocarbyl or hydrocarbon group, such as methylene, ethylene, and like groups.

The term "hydrocarbyl" includes hydrocarbon, as well as substantially hydrocarbon, groups. Substantially hydrocarbon describes groups which contain non-hydrocarbon substituents which do not alter the predominantly hydrocarbon nature of the group. Non-hydrocarbon substituents include halo (especially chloro and fluoro), hydroxy, alkoxy, mercapto, alkylmercapto, nitro, nitroso, sulfoxy, etc., groups. The hydrocarbyl group may also have a heteroatom, such as sulfur, oxygen, or nitrogen, in a ring or chain. In general, no more than about 2, preferably no more than one, non-hydrocarbon substituent will be present for every ten carbon atoms in the hydrocarbyl group. Typically, there will be no such non-hydrocarbon substituents in the hydrocarbyl group. Therefore, the hydrocarbyl group is purely hydrocarbon.

The froth flotation process of the present invention is useful to beneficiate mineral and metal values from sulfide ores including, for example, copper, lead, molybdenum, zinc, etc. Gold may be beneficiated as native gold or from such gold-bearing minerals as sylvanite ($AuAgTe_2$) and calaverite (AuTe). Silver may be beneficiated from argentite ($Ag_2S$). Lead can be beneficiated from minerals such as galena (PbS) and zinc can be beneficiated from minerals such as sphalerite (ZnS). Cobalt-nickel sulfide ores such as siegenite or linnalite can be beneficiated in accordance with this invention. The copper can be beneficiated from minerals such as calcocite ($Cu_2S$), covellite (CuS), bornite ($Cu_5FeS_4$), chalcopyrites ($CuFeS_2$) and copper-containing minerals commonly associated therewith. The invention is useful particularly in beneficiating the complex copper sulfide minerals such as the porphyry copper-molybdenum ores obtained from the Southwest of the United States of America. The complex sulfide ores contain large amounts of pyrite, (and other iron sulfides) which generally are relatively difficult to separate from the desired minerals.

In the following description of the invention, however, comments primarily will be directed toward the beneficiation and recovery of gold and copper, and it is intended that such discussion shall also apply to the other above-identified minerals. In the claims and specification, "primary mineral" is a mineral of major economic importance. Other minerals may be present and collected. For instance, a lead-zinc containing ore may contain some copper but the process is intended to recover a maximized amount of lead and zinc. Therefore the primary minerals are lead and zinc.

The ores which are treated in accordance with the process of the present invention must be reduced in particle size to provide ore particles of flotation size. As is apparent to those skilled in the art, the particle size to which an ore must be reduced in order to liberate mineral values from associated gangue and non-value metals will vary from ore to ore and depends upon several factors, such as, for example, the geometry of the mineral deposits within the ore, e.g., striations, agglomerations, etc. Generally, suitable particle sizes are minus 10 mesh (1000 microns) (Tyler) with 50% or more passing 200 mesh (70 microns). The size reduction of the ores may be performed in accordance with any method known to those skilled in the art. For example, the ore can be crushed to about minus 10 mesh (1000 microns) size followed by wet grinding in a steel ball mill to specified mesh size ranges. Alternatively, pebble milling may be used. The procedure used in reducing the particle size of the ore is not critical to the method of this invention so long as particles of effective flotation size are provided.

Water is added to the grinding mill to facilitate the size reduction and to provide an aqueous pulp or slurry. The amount of water contained in the grinding mill may be varied depending on the desired solid content of the pulp or slurry obtained from the grinding mill. Conditioning agents may be added to the grinding mill prior to or during the grinding of crude ore. Optionally, water-soluble inorganic bases and/or collectors also may be included in the grinding mill.

At least one collector of the present invention is added to the grinding mill to form the aqueous slurry or pulp. The collector may be added prior to, during, or after grinding of the crude ore. The collector of the present invention is (A) at least one metal salt of a phosphorus acid.

The phosphorus acid is represented by the Formula

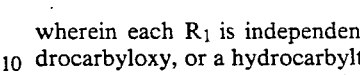

$$(R_1)_2-\overset{\overset{\displaystyle X}{\|}}{P}-XH \qquad (I)$$

wherein each $R_1$ is independently a hydrocarbyl, hydrocarbyloxy, or a hydrocarbylthio group having from 1 to about 18 carbon atoms and each X is independently oxygen or sulfur.

Preferably, each $R_1$ independently contains from 1 to about B carbon atoms, more preferably about 3 to about 6. Preferably, each $R_1$ is independently an alkyl, aryl, alkoxy, aryl, aryloxy, alkylthio or arylthio group, more preferably an alkyl, aryl, alkoxy or aryloxy group, with an alkoxy or aryloxy group being more preferred. Each $R_1$ may be independently derived from any of the monohydroxy organic compounds listed below. Examples of $R_1$ include propyl, propoxy, propylthio, butyl, butoxy, butylthio, amyl, amyloxy, amylthio, hexyl, hexyloxy and hexylthio groups. The above list is meant to include all stereo arrangements of the above groups. For instance, butyl is meant to include isobutyl, sec-butyl, n-butyl, etc. In a preferred embodiment, one $R_1$ is a isopropoxy or isobutoxy group and the other $R_1$ is an amyloxy or a methylamyloxy group.

When $R_1$ is an aryl, aryloxy or arylthio group, $R_1$ contains from 6 to about 18 carbon atoms, more preferably 6 to about 10. Examples of aromatic $R_1$ groups include cresyl, cresyloxy, cresylthio, xylyl, xylyloxy, xylylthio, heptylphenol, and heptylphenolthio groups, preferably cresyl or cresyloxy groups.

In Formula I, X may be oxygen or sulfur, more preferably sulfur. In one embodiment, one X is oxygen and the other X is sulfur. In another embodiment, each X is sulfur.

The phosphorus acids useful in the present invention include phosphoric; phosphonic; phosphinic; thiophosphoric; thiophosphinic; or thiophosphonic acids. Use of the terms thiophosphoric, thiophosphonic and thiophosphinic acids is meant to encompass monothio as well as dithio forms of these acids. The phosphorus acids are known compounds and may be prepared by known methods. Preferably, the phosphorus acid is a dithiophosphoric acid.

Dithiophosphoric acids are known compounds and may be prepared by the reaction of a mixture of hydroxycontaining organic compounds such as alcohols and phenols with a phosphorus sulfide such as $P_2S_5$. The dithiophosphoric acids generally are prepared by reacting from about 3 to 5 moles, more generally 4 moles of the hydroxy-containing organic compound (alcohol or phenol) with one mole of phosphorus pentasulfide in an inert atmosphere at temperatures from about 50° C. to about 200° C. with the evolution of hydrogen sulfide. The reaction normally is completed in about 1 to 3 hours.

Monohydroxy organic compounds useful in the preparation of the dihydrocarbylphosphorodithioic acids and salts useful in the present invention include alcohols, xylenols, alkyl xylenols, phenols and alkyl phenols including their substituted derivatives, e.g., nitro-, halo-, alkoxy-, hydroxy-, carboxy-, etc. Suitable alcohols include, for example, ethanol, n-propanol, isopropanol, n-butanol, 2-butanol, 2-methylpropanol, n-pentanol, 2-pentanol, 3-pentanol, 2-methylbutanol, 3-methyl-2-pentanol, n-hexanol, 2-hexanol, 3-hexanol, 4-methyl-2-pentanol, 2-methyl-3-pentanol, cyclohexanol, chlorocylohexanol, methylcyclohexanol, heptanol, 2-ethylhexanol, n-octanol, nonanol, dodecanol, etc. The phenols suitable for the purposes of the invention include alkyl phenols and substituted phenols such as phenol, chlorophenol, bromophenol, nitrophenol, methoxyphenol, cresol, propylphenol, heptylphenol, octylphenol, decylphenol, dodecylphenol, and commercially available mixtures of phenols. The aliphatic alcohols containing from about 4 to 6 carbon atoms are particularly useful in preparing the dithiophosphoric acids.

In a preferred embodiment, the composition of the phosphorodithioic acid obtained by the reaction of a mixture of hydroxy-containing organic compounds with phosphorus pentasulfide is actually a mixture of phosphorodithioic acids wherein one hydrocarbyl group may be derived from the same hydroxy compound as the other hydrocarbyl group, or one hydrocarbyl group may be derived from a different hydroxy compound than the other hydrocarbyl group. In the present invention it is preferred to select the amount of the two or more hydroxy compounds reacted with $P_2P_5$ to result in a mixture in which the predominating dithiophosphoric acid is the acid (or acids) containing two different hydrocarbyl groups.

Typical mixtures of alcohols and phenols which can be used in the preparation of dithiophosphoric acids and salts of Formula I include: isobutyl and n-amyl alcohols; sec-butyl and n-amyl alcohols; propyl and n-hexyl alcohols; isobutyl alcohol, n-amyl alcohol and 2-methyl-1-butanol; phenol and n-amyl alcohol; phenol and cresol, etc.

Salts of the above phosphorus acid may be prepared by techniques known to those in the art. The acids are usually reacted with metal bases. The metal bases are generally oxides, hydroxides, etc.

In one embodiment, the metal of the metal salt is (i) a single metal having a lowest oxidation state of plus two. Typically, the metals include Group IIA, IIB-VIIB and VIII metals, preferably Group IIB-VIIB and VIII metals, more preferably Group IIB, IVB, VIIB and VIII metals. The above group numbers correspond to the CAS designation of groups in the Periodic Table of Elements. Preferably, the metals include calcium, magnesium, titanium, chromium, manganese, iron, cobalt, nickel and zinc, more preferably titanium, manganese, iron, cobalt and zinc, with zinc being highly preferred when the primary mineral is not a copper, zinc, lead or silver mineral.

In another embodiment, the metal of the metal salt is (ii) at least one mixture of metals wherein at least one of the metals has a lowest oxidation state of plus two. The mixture of metals contains one or more of the single metals (i) described above. Preferably, the mixture of metals contains at least one metal with a lowest oxidation state of plus two and a Group IA, IIA or IB metal, more preferably an alkali or alkaline earth metal. Typically, the mixture includes zinc and sodium, potassium, calcium, manganese or copper, preferably zinc and sodium or calcium.

Metal salts of phosphorodithioic acids may be referred to as "mixed metal" or "multiple metal" salts or complexes. The salts may be prepared as described above. Alternatively, the mixed metal salts may be prepared by reacting a metal salt of a phosphorodithioic acid with an additional metal-containing reactant. This reaction may additionally be performed in the presence of a catalytic amount of an alkali or alkaline earth metal oxide, hydroxide, halide or carbonate. The catalyst metal will not be the same as the metal of the metal-containing reactant. In general, a catalytic amount contains about 0.001 to 0.05 equivalents of an alkali or alkaline earth metal per equivalent of phosphorus in the acid or its salt.

The mixed metal phosphorodithioic acid salts and methods for making the same are disclosed in U.S. Pat. Nos. 4,466,895 and 4,089,793 and PCT Published International Application WO 89/06237, the disclosures of which are hereby incorporated by reference for their teachings related to mixed metal phosphorodithioates and processes for making the same.

The phosphorodithioic acids and salts useful as collectors in the process of the present invention are exemplified by the acids and salts prepared in the following examples. Unless otherwise indicated in the following examples and elsewhere in the specification and claims, all parts and percentages are by weight and all temperatures are in degrees Celsius.

EXAMPLE 1

A reaction vessel is charged with 804 parts of a mixture of 6.5 moles of isobutyl alcohol and 3.5 moles of mixed primary amyl alcohols (65%w n-amyl and 35%w 2-methyl-1-butanol). Phosphorus pentasulfide (555 parts, 2.5 moles) is added to the vessel while maintaining the reaction temperature between about 104°-107° C. After all of the phosphorus pentasulfide is added, the mixture is heated for an additional period to insure completion of the reaction and filtered. The filtrate is the desired phosphorodithioic acid which contains about 11.2% phosphorus and 22.0% sulfur.

A reaction vessel is charged with 448 parts of zinc oxide (11 equivalents) and 467 parts of the above alcohol mixture. The above phosphorodithioic acid (3030 parts, 10.5 equivalents) is added at a rate to maintain the reaction temperature at about 45°-50° C. The addition is completed in 3.5 hours whereupon the temperature of the mixture is raised to 75° C. for 45 minutes. After cooling to about 50° C., an additional 61 parts of zinc oxide (1.5 equivalents) are added, and this mixture is heated to 75° C. for 2.5 hours. After cooling to ambient temperature, the mixture is stripped to 124° C. at 12 mm. pressure. The residue is filtered twice through diatomaceous earth, and the filtrate is the desired zinc salt containing 22.2% sulfur (theory, 22.0), 10.4% phosphorus (theory, 10.6) and 10.6% zinc (theory, 11.1).

EXAMPLE 2

A reaction vessel is charged with a mixture of 246 parts (2 equivalents) of Cresylic Acid 33 (a mixture of mono-, di- and tri-substituted alkyl phenols containing from 1 to 3 carbon atoms in the alkyl group commercially available from Merichem Company of Houston, Texas), 260 parts (2 equivalents) of isooctyl alcohol and 14 parts of caprolactam. The mixture is heated to 55° C. under a nitrogen atmosphere, where phosphorus pentasulfide (222 parts, 2 equivalents) is added in portions over a period of one hour while maintaining the temperature at about 78° C. The mixture is maintained at this temperature for an additional hour until completion of the phosphorus pentasulfide addition and then cooled to room temperature. The reaction mixture is filtered through diatomaceous earth and the filtrate is the desired phosphorodithioic acid.

A reaction vessel is charged with a mixture of 63 parts (1.55 equivalents) of zinc oxide, 144 parts of mineral oil and one part of acetic acid. A vacuum of 15–40 mm Hg is applied and 533 parts (1.3 equivalents) of the above phosphorodithioic acid are added while heating the mixture to about 80° C. The temperature is maintained at 80°–85° C. for about 7 hours after the addition of the phosphorodithioic acid is complete. The residue is filtered, and the filtrate contains 6.8% phosphorus.

EXAMPLE 3

A reaction vessel is charged with a mixture of 2945 parts (24 equivalents) of Cresylic Acid 57 (a mixture of 56% mono- and 41% di-substituted alkyl phenols containing from 1 to 3 carbon atoms in the alkyl group available from Merichem) and 1152 parts (6 equivalents) of heptylphenol. The mixture is heated to 105° C. under a nitrogen atmosphere whereupon 1665 parts (15 equivalents) of phosphorus pentasulfide are added in portions over a period of 3 hours while maintaining the temperature of the mixture between about 115°–120° C. The mixture is maintained at this temperature for an additional 1.5 hours upon completion of addition of the phosphorus pentasulfide and then cooled to room temperature. The reaction mixture is filtered through a diatomaceous earth, and the filtrate is the desired phosphorodithioic acid.

A reaction vessel is charged with a mixture of 541 parts (13.3 equivalents) of zinc oxide, 14.4 parts (0.24 equivalent) of acetic acid and 1228 parts of mineral oil. A vacuum of 15–40 mm Hg is applied while raising the temperature to about 70° C. The above phosphorodithioic acid (4512 parts, 12 equivalents) is added over a period of about 5 hours while maintaining the temperature at 68°–72° C. Water is removed as it forms in the reaction, and the temperature is maintained at 68°–72° C. for 2 hours after the addition of phosphorodithioic acid is complete. To insure complete removal of water, vacuum is adjusted to about 6.0 mm Hg, and the temperature is raised to about 105° C. and maintained for 2 hours. The residue is filtered, and the filtrate contains 6.26% phosphorus (theory, 6.09) and 6.86% zinc (theory, 6.38).

EXAMPLE 4

A reaction vessel is charged with 100 milliliters of isopropyl alcohol, 32 parts of a 100 neutral mineral oil and 310 parts of a phosphorodithioic acid prepared by the procedure described in Example 1 except that 4.0 moles of isopropyl alcohol and 6.0 moles of methylamyl alcohol are used. Sodium hydroxide (80 parts of a 50% solution of sodium hydroxide in water) is added while maintaining the reaction temperature below 45° C. After addition, the mixture is stirred for 1.5 hours. Cobaltous nitrate (16 parts, 1.15 equivalents) is added to the vessel over one hour. The mixture is stirred for three hours. The mixture is transferred to a separatory funnel and washed using xylene and water. The washed organic layer is removed and vacuum stripped to 100° C. and 15 mm Hg. The residue contains 18.11% sulfur (theoretical 17.21), 8.68% phosphorus (theoretical 8.33), 6.56% cobalt (theoretical 7.92) and 9% oil.

EXAMPLE 5

A reaction vessel is charged with 138 parts, 2.3 equivalents of nickelous carbonate, 79 parts of Calumet 3800 (processed naphthenic oil having a kinematic viscosity of 3.1 to 3.8 cSt at 40° C.) and 150 milliliters of toluene. The phosphorodithioic acid of Example 4 (614 parts, 2 equivalents) is added to the reaction vessel while maintaining the reaction temperature below 45° C. After addition of the phosphordithioic acid, the reaction temperature is maintained at 45° C. for three hours. The reaction mixture is vacuum stripped to 100° C. and 15 mm Hg. The residue is cooled and filtered through diatomaceous earth. The residue is a purple liquid and contains 19.7% sulfur (theoretical 17.06), 9.47% phosphorus (theoretical 8.91), 8.75% nickel (theoretical 8.72) and 10% of Calumet 3800.

EXAMPLE 6

A reaction vessel is charged with 350 parts, 1.26 equivalents of the phosphorodithioic acid of Example 4 and purged with nitrogen for one hour. The vessel is then charged with 53 parts of 100 neutral mineral oil and 150 parts, 1.42 equivalents of lead oxide. The reaction temperature increases exothermically to 50° C. The reaction temperature is increased to 60°–70° C. and maintained for two hours. The reaction mixture is vacuum stripped to 100° C. and 15 mm Hg. The residue has 14.73% sulfur (theoretical 14.5) and 10% oil. The residue is a dark brown solid at room temperature.

EXAMPLE 7

A reaction vessel is charged with 97.2 parts, 2 equivalents of antimony trioxide and 89 parts of 100 neutral diluent oil. At 25° C., 734 parts, 1.74 equivalents of a diisooctyl phosphorodithioic acid having 16.5% sulfur and 8.0% phosphorus is added to the reaction mixture. The reaction temperature increases exothermically to about 45° C. After addition of the phosphorodithioic acid, the reaction mixture is heated to 80° C. and maintained for three hours. The mixture is vacuum stripped to 105° C. and 15 mm Hg. The residue has 13.8% sulfur (theoretical 12.52), 6.22% phosphorus (theoretical 6.06), 7.8% antimony (theoretical 7.94) and 10% oil.

EXAMPLE 8

A reaction vessel is charged with 44 parts, 1.2 equivalents, of calcium hydroxide and 50 parts of a mixture of 50 parts isobutyl alcohol and 50 parts amyl alcohol. The reaction vessel is then charged with 395 parts, 1 equivalent of a diethylhexyl phosphorodithioic acid containing 16.4% sulfur and 8.0% phosphorus. The reaction temperature is increased to 70° C. to 80° C. and maintained for three hours. The mixture is vacuum stripped to 100° C. and 10 mm Hg. The residue is cooled to 60° C. where 150 parts of water is added to the residue. The mixture is filtered through diatomaceous earth. The filtrate has 0.8% sulfur, 4.13% phosphorus, 3.45% calcium and 26% water.

EXAMPLE 9

A reaction vessel is charged with 864 parts, 6 moles, of molybdenum trioxide and 1500 parts of distilled water. The mixture is stirred at room temperature where 2388 parts, 6 moles of di-2-ethylhexyl phosphorodithioic acid is added over 0.3 hours. The mixture is heated to 80°–85° C., where 340 parts, 10 moles of hydrogen sulfide is added to the mixture at a rate of 6 –7 standard cubic feet per hour for 6.5 hours. Any excess hydrogen sulfide is removed by nitrogen purging. The reaction mixture is stripped to 95°–100° C. and 10 mm Hg. Soybean oil (836 parts) and $C_{15-18}$ alpha-olefin (501 parts) are added to the mixture below 90° C. The mixture is heated to 130° C. and held for three hours. The mixture is filtered through diatomaceous earth. The filtrate has 16.14% sulfur (theoretical 14.36), 3.95% phosphorus (theoretical 3.97), and 12.39% molybdenum (theoretical 12.32).

EXAMPLE 10

A reaction vessel is charged with 1100 parts, 1.66 moles of a zinc salt of the phosphorodithioic acid of Example 4; 41 parts, 0.55 moles of calcium hydroxide; 20 milliliters of water; and 400 milliliters of toluene. The mixture is heated to 80° C. and held for six hours. The mixture is vacuum stripped to 100° C. and 10 mm Hg. The residue is cooled to 60° C. where 400 parts of toluene is added to the residue and the mixture is stirred. The mixture is filtered through diatomaceous earth and vacuum stripped to 100° C. and 10 mm Hg. The residue has 20.44% sulfur (theoretical 19.5), 9.5% phosphorus (theoretical 9.3), 10.8% zinc (theoretical 10.2), and 2.5% calcium (theoretical 1.97).

EXAMPLE 11

A reaction vessel is charged with 40 parts, 1.1 equivalents of manganese oxide; 5.1 parts, 0.1 equivalents of zinc oxide; and 48 parts of 100 neutral mineral oil. The phosphorodithioic acid of Example 4 (385 parts, 1.1 equivalents) is added to the vessel. The reaction temperature is increased to 60°-65° C. and stirred for four hours. The mixture is filtered through diatomaceous earth. The filtrate has 18.52% sulfur (theoretical 16.29); 9.23% phosphorus (theoretical 7.89); 6.88% manganese (theoretical 6.90); 0.94% zinc (theoretical 0.91) and 10% oil.

EXAMPLE 12

A reaction container is charged with 147 grams of zinc diisooctyldithiophosphate, 4.1 grams of calcium hydroxide and 10 grams of water. The mixture is heated to 95° C. and the temperature is maintained at 95° C. for 5 hours. The mixture is vacuum stripped to 110° C. and 20 mm Hg. Final product yields 148 grams after filtering through diatomaceous earth filter aid.

EXAMPLE 13

A reaction vessel is charged with 34 grams of zinc oxide, 18 grams of copper (I) oxide, 33 grams of 100 neutral mineral oil and 256 grams of a dialkyldithiophosphoric acid (the alkyl groups are a 60/40 mixture of methylamyl/isopropyl, respectively). The addition of these reactants takes place over a period of 1.5 hours where the temperature is maintained at less than 60° C. After the addition is complete, the mixture is heated to 75° C. and maintained at that temperature for 4.5 hours. After filtering through diatomaceous earth filter aid, 270 grams of product is obtained.

The amount of the collector of the present invention included in the slurry to be used in the flotation process is an amount which is effective in promoting the froth flotation process and providing improved separation of the desired mineral values. The amount of collector of the present invention included in the slurry will depend upon a number of factors including the nature and type of ore, size of ore particles, etc. In general, the collector is present in an amount from about 0.5 to about 500 parts of collector per million parts of ore, preferably about I to about 50, more preferably 1.5 to about 40.

In the process of the present invention, a base may be included to provide desirable pH values. Desirable pH values are about 8 and above, preferably about 8 to about 13, more preferably about 9 to about 12, with about 10 to about 12 being highly preferred. Alkali and alkaline earth metal oxides and hydroxides are useful inorganic bases. Lime is a particularly useful base. In the process of the present invention for gold concentration, it has been discovered that the addition of a base to the ore or slurry containing the collectors of this invention results in a significant increase in the gold assay of the cleaner concentrates.

The slurries used in this invention will contain from about 20% to about 50% by weight of solids, and more generally from about 30% to 40% solids. Such slurries can be prepared by mixing all the above ingredients. Alternatively, the collector and inorganic base can be premixed with the ore either as the ore is being ground or after the ore has been ground to the desired particle size. Thus, in one embodiment, the ground pulp is prepared by grinding the ore in the presence of collector and inorganic base and this ground pulp is thereafter diluted with water to form the slurry. The amount of inorganic base included in the ground ore and/or the slurry prepared from the ore is an amount which is sufficient to provide the desired pH to the slurry. Generally, the amount of inorganic base is from about 250 to about 2000 parts of inorganic base per million parts of ore, preferably from about 375 to about 1500. This amount may be varied by one skilled in the art depending on particular preferences.

In step (2), the slurry is subjected to a froth flotation to form a froth and an underflow. Most of the gold values collect in the froth (concentrate) while significant quantities of undesirable minerals and gangue are contained in the underflow. The flotation stage of the flotation system comprises at least one flotation stage wherein a rougher concentrate is recovered, and/or one or more cleaning stages wherein the rougher concentrate is cleaned and upgraded. Tailing products from each of the stages can be routed to other stages for additional mineral recovery.

The gold rougher flotation stage will contain at least one frother, and the amount of frother added will be dependent upon the desired froth characteristics which can be selected with ease by one skilled in the art. A typical range of frother addition is from about 20 to about 50 parts of frother per million parts of dry ore.

A wide variety of frothing agents have been used successfully in the flotation of minerals from base metal sulfide ores, and any of the known frothing agents can be used in the process of the present invention. By way of illustration, such frothing agents as straight or branched chain low molecular weight hydrocarbon alcohols such as $C_{6-8}$ alkanols, 2-ethylhexanol and 4-methyl-2-pentanol (also known as methylisobutylcarbinol, MIBC) may be employed as well as pine oils, cresylic acid, polyglycol or monoethers of polyglycols and alcohol ethoxylates.

An essential ingredient of the slurry contained in the gold rougher stage is one or more of the collectors described above. In one embodiment, the collector is included in the slurry in step (2), and additional collector may be added during the flotation steps including the rougher stage as well as the cleaner stage. In addition to the collectors of the present invention, other types of collectors normally used in the flotation of sulfide ores can be used. The use of such auxiliary collectors in combination with the collectors of this invention often results in improved and superior recovery of more concentrated gold values. These auxiliary collectors also may be added either to the rougher stage or the cleaning stage, or both.

The most common auxiliary collectors are hydrocarbon compounds which contain anionic or cationic polar groups. Examples include the fatty acids, the fatty acid soaps, xanthates, xanthate esters, xanthogen formates, dithiocarbamates, especially alkylene bisdithiocarbamates, fatty sulfates, fatty sulfonates, mercaptans, and thioureas. The xanthates are particularly useful auxiliary collectors.

One group of xanthate collectors which has been utilized in froth flotation processes may be represented by the formula $$R_7-O-\overset{\overset{\displaystyle S}{\|}}{C}SM$$

wherein $R_7$ is an alkyl group containing from 1 to 6 carbon atoms and M is a dissociating cation such as sodium or potassium. Examples of such xanthates include potassium amyl xanthate, sodium amyl xanthate, etc.

Hydrocarboxycarbonyl thionocarbamate compounds also have been reported as useful collectors for beneficiating sulfide ores. The hydrocarboxycarbonyl thionocarbamate compounds are represented by the formula $$R_{10}O\overset{\overset{\displaystyle O}{\|}}{C}N(H)\overset{\overset{\displaystyle S}{\|}}{C}OR_{11}$$

wherein $R_{10}$ and $R_{11}$ are each independently selected from saturated and unsaturated hydrocarbyl groups, alkyl polyether groups and aromatic groups. The preparation of these hydrocarboxycarbonyl thionocarbamic compounds and their use as collectors is described in U.S. Pat. No. 4,584,097, the disclosure of which is hereby incorporated by reference. Specific examples of auxiliary collectors which may be utilized in combination with the collectors of the present invention include: sodium isopropyl xanthate, N-ethoxycarbonyl N,-isopropylthiourea, etc.

In the flotation step (2), the slurry is frothed for a period of time which maximizes gold recovery. The precise length of time is determined by the nature and particle size of the ore as well as other factors, and the time necessary for each individual ore can be readily determined by one skilled in the art. Typically, the froth flotation step is conducted for a period of from 2 to about 20 minutes and more generally from a period of about 5 to about 15 minutes. As the flotation step proceeds, small amounts of collectors may be added periodically to improve the flotation of the desired mineral values. Additional amounts of the collector of the present invention may be added periodically to the rougher concentrate and included in the slurry.

When the froth flotation has been conducted for the desired period of time, the gold rougher concentrate is collected, and the gold rougher tailing product is removed and may be subjected to further purification.

The recovered gold rougher concentrate may be processed further to improve the gold grade and reduce the impurities within the concentrate. One or more cleaner flotation stages can be employed to improve the gold grade to a satisfactory level without unduly reducing the overall gold recovery of the system. Generally, two cleaner flotation stages have been found to provide satisfactory results.

Prior to cleaning, however, the gold rougher concentrate is finely reground to reduce the particle size to a desirable level. In one embodiment, the particle size is reduced so that 60% is less than 400 mesh (35 microns). The entire gold rougher concentrate can be comminuted to the required particle size or the rougher concentrate can be classified and only the oversized materials comminuted to the required particle size. The gold rougher concentrate can be classified by well-known means such as hydrocyclones. The particles larger than desired are reground to the proper size and are recombined with the remaining fraction.

The reground gold rougher concentrate then is cleaned in a conventional way by forming an aqueous slurry of the reground gold rougher concentrate in water. One or more frothers and one or more collectors are added to the slurry which is then subjected to a froth flotation. The collector utilized in this cleaner stage may be one or more of the collectors of the present invention and/or any of the auxiliary collectors described above. In some applications, the addition of collector and a frother to the cleaning stage may not be necessary if sufficient quantities of the reagents have been carried along with the concentrate from the preceding gold rougher flotation. The duration of the first gold cleaner flotation is a period of from about 5 to about 20 minutes, and more generally for about 8 to about 15 minutes. At the end of the cleaning stage, the froth containing the gold cleaner concentrate is recovered and the underflow which contains the gold cleaner tailings is removed. In one preferred embodiment, the gold cleaner concentrate recovered in this manner is subjected to a second cleaning stage and which the requirements for collector and frother, as well as the length of time during which the flotation is carried out to obtain a highly satisfactory gold content and recovery can be readily determined by one skilled in the art.

In another embodiment, the slurry from step (1) is subjected to conditioning with sulfurous acid. The conditioning acts to suppress iron. This embodiment is especially useful for copper ores. After the ore slurry has been prepared in accordance with any of the embodiments described above, it is useful in some flotation procedures to condition the slurry with sulfur dioxide under aeration at a pH of from about 5.5 to about 7.5. The conditioning medium may be an aqueous solution formed by dissolving sulfur dioxide in water forming sulfurous acid ($H_2SO_3$) It has been found that when certain ore slurries are conditioned with sulfurous acid and aerated, the $SO_2$ increases the flotation rate of copper minerals, and depresses the undesired gangue and undesirable minerals such as iron resulting in the recovery in subsequent treatment stages of a product that represents a surprising high recovery of copper values and a surprising low retention of iron. The amount of sulfur dioxide added to the slurry in the conditioning step can be varied over a wide range, and the precise amounts useful for a particular ore or flotation process can be readily determined by one skilled in the art. In general, the amount of sulfur dioxide utilized in the conditioning step is within the range of from about 500 to about 5000 parts of sulfur dioxide per million parts of ground ore. The pH of the conditioned slurry should be maintained between about 5.5 and about 7.5, more preferably between about 6.0 to about 7.0. A pH of about 6.5 to about 7.0 is particularly preferred for the conditioned slurry.

Conditioning of the slurry is achieved by agitating the pulp contained in a conditioning tank such as by vigorous aeration and optionally, with a suitable agitator such as a motor-driven impeller, to provide good solid-liquid contact between the finely divided ore and the sulfurous acid. The pulp is conditioned sufficiently long to maximize depression of the undesirable minerals and gangue while maximizing activation of the desired minerals such as copper minerals. Thus, conditioning time will vary from ore to ore, but it has been found for the ores tested that conditioning times of between about to 10 minutes and more generally from about 3 to 7 minutes provide adequate depression of the undesirable minerals and gangue.

One of the advantages of the conditioning step is that it allows recovery of a concentrate having satisfactory copper content without requiring the introduction of lime, cyanide or other conditioning agents to the flotation circuit, although as mentioned above, the introduction of some lime frequently improves the results obtained. Omitting these other conditioning agents, or reducing the amounts of lime or other conditioning agents offers relief for both the additional costs and the environmental and safety factors presented by these agents. However, as noted below, certain advantages are obtained when small amounts of such agents are utilized in the flotation steps.

When using the sulfurous acid conditioning step, the flotation of copper is effected in the copper rougher stage at a slightly acidic pulp pH which is generally between about 6.0 and 7.0, the pH being governed by the quantity of sulfur dioxide used during the conditioning and aeration as well as the quantity of any inorganic base included in the slurry.

When the process of the present invention is carried out on copper sulfide ores, and in particular, copper sulfide ores from the Southwest of the United States of America, cleaned copper concentrates are found to contain high concentrations of copper with improved recoveries.

The following table contains results of a gold flotation process using a collector of the present invention and Aerofloat® 25, a dicresyldithiophosphoric acid collector available from American Cyanamid Chemical Company. All parts are parts per million parts of ore. The assay of the gold ore is contained in the following table. The ore, collector (amount shown in table below), and 150 parts of sodium carbonate are ground for 10 minutes at 60% solids. Seven percent of the particles are greater than 100 mesh. The slurry is conditioned for one minute at 30% solids in the presence of 75 parts of collector and 16 parts methylisobutylcarbinol. The pH of the conditioning step is approximately 8.5. The slurry is then subjected to froth flotation for ten minutes followed by a second conditioning step. The second conditioning of the slurry occurs for one minute in the presence of 6 parts of methylisobutylcarbinol and 2.5 parts of potassium amyl xanthate. The slurry is subjected to a second froth flotation for 7 minutes.

TABLE

| Collector | Amount of Gold in Ore | % Ore Recovery | % Gold Recovery |
|---|---|---|---|
| Product of Example 1 | 1.41 ppm[1] | 11.8 | 94.2 |
| Aerofloat® 25 | 1.85 ppm | 15.1 | 95.1 |

[1]ppm = parts of gold per million parts of ore

The gold recovery of the collector of the present invention and commercially available collector are similar. The amount of gold (0.094 ppm) left in the tail from the beneficiation is the same for both collectors. However, the collector of the present invention recovered 22% less ore than the commercially available collector. The reduced amount of recovered ore provides substantial cost savings in later processing and transport procedures involving the metal values.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A gold recovery process comprising the steps of:

(1) forming a slurry comprising a gold-containing ore, water and a collector which is at least one metal salt of a phosphorus acid represented by the Formula:

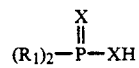

(I)

wherein each $R_1$ is independently a hydrocarbyl, hydrocarbyloxy or hydrocarbylthio group having from to 1 to about 18 carbon atoms, each X is independently oxygen or sulfur, and wherein the metal is (i) at least one single metal selected from the group consisting of Group IIB–VIIB and VIII metals two or (ii) at least one mixture of metals wherein at least one of the metals is selected from the group consisting of IIB–VIIB and VIII metals.

(2) subjecting the slurry from step (1) to froth flotation to produce a froth; and (3) recovering gold from the froth.

2. The process of claim wherein each $R_1$ is independently an alkyl or alkoxy group having from 1 to about 18 carbon atoms or an aryl or aryloxy group having from about 6 to about 18 carbon atoms.

3. The process of claim 1, wherein each $R_1$ is independently an alkoxy group having from 1 to about 8 carbon atoms.

4. The process of claim wherein each $R_1$ is independently a propoxy, butoxy, amyloxy or hexyloxy group.

5. The process of claim wherein each $R_1$ is independently an aryloxy group having from 6 to about 10 carbon atoms.

6. The process of claim wherein each $R_1$ is independently a cresyloxy, xylyloxy or heptylphenyloxy group.

7. The process of claim wherein each X is sulfur.

8. The process of claim 1, wherein the metal of the metal salt is (i) a single metal.

9. The process of claim 8, wherein the metal is calcium, magnesium, titanium, chromium, manganese, iron, cobalt, nickel or zinc.

10. The process of claim 8, wherein the metal (i) is zinc.

11. The process of claim 1, wherein the metal of the metal salt is (ii) a mixture of metals.

12. The process of claim wherein the mixture contains at least one Group IA, IIA or IB metal.

13. The process of claim 11, wherein the mixture contains zinc and at least one of sodium, calcium, manganese or copper.

14. The process of claim 11, wherein the mixture contains zinc and at least one of sodium or calcium.

15. The process of claim 1, wherein step (1) further comprises:

including an inorganic base in the slurry.

16. The process of claim 15 wherein the inorganic base is an alkali metal or alkaline earth metal oxide or hydroxide.

17. The process of claim 1, wherein the collector is present in an amount from about 0.5 to about 500 parts of collector per million parts of ore.

18. The process of claim 1, further comprising (4) cleaning and upgrading the gold recovered in step (3).

19. A gold recovery process comprising the steps of:

(1) forming a slurry comprising an ore containing gold, water and from 0.5 to 500 parts of at least one collector per million parts of ore, wherein the collector is (A) at least one metal salt of a dithiophosphoric acid represented by the Formula

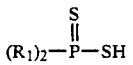

(I)

wherein each $R_1$ is independently an alkyl or alkoxy group having from 1 to about 18 carbon atoms or an aryl or aryloxy group having from about 6 to about 18 carbon atoms and wherein the metal is (i) at least one single metal selected from the group consisting of Group IIB–VIIB and VIII metals (ii) a mixture of at least one metal selected from the group consisting of Group IIB–VIIB and VIII metals with at least one Group IA, IIA and IB metal;

(2) subjecting the slurry from step (1) to froth flotation to produce a froth; and (3) recovering gold from the froth.

20. The process of claim 19, wherein each $R_1$ is independently an alkoxy group having from 1 to about 8 carbon atoms.

21. The process of claim 19, wherein each $R_1$ is independently a propoxy, butoxy, amyloxy or hexyloxy group.

22. The process of claim 19, wherein each $R_1$ is independently an aryloxy group having from 6 to about 10 carbon atoms.

23. The process of claim 19, wherein each $R_1$ is independently a cresyloxy, xylyloxy or heptylphenyloxy group.

24. The process of claim 19, wherein the metal of the metal salt is (i) a single metal.

25. The process of claim 24, wherein the metal is zinc.

26. The process of claim 19, wherein the collector is present in an amount from about 0.5 to about 500,parts of collector per million parts of ore.

27. The process of claim 19 , further comprising (4) cleaning and upgrading the gold recovered in step (3).

* * * * *